United States Patent [19]

Hebern

[11] 4,270,749

[45] Jun. 2, 1981

[54] EXERCISING DEVICE

[76] Inventor: William D. Hebern, 1145 W. Griffith Way, Fresno, Calif. 93705

[21] Appl. No.: 57,725

[22] Filed: Jul. 16, 1979

[51] Int. Cl.[3] ..... A63B 23/04

[52] U.S. Cl. ..... 272/96; 272/146

[58] Field of Search ..... 272/93, 96, 70, 126, 272/134, 144, 146; 128/25 R, 25 B

[56] References Cited

U.S. PATENT DOCUMENTS

| | | | |
|---|---|---|---|
| 3,379,434 | 4/1968 | Guzaldo | 272/144 |
| 3,525,522 | 8/1970 | Piller | 272/146 X |
| 3,659,844 | 5/1972 | Cummins | 272/134 |
| 3,713,653 | 1/1973 | Romans | 272/146 |
| 4,183,521 | 1/1980 | Kroeker | 272/146 |

*Primary Examiner*—Richard J. Johnson

*Attorney, Agent, or Firm*—Huebner & Worrel

[57] ABSTRACT

An exercising device for use by a person in a standing position, the device having a parallelpiped frame defining a stall and a planar treadle mounted on the stall for rocking movement about a horizontal axis extending transversely of the stall and in the lower portion thereof.

1 Claim, 4 Drawing Figures

EXERCISING DEVICE

BACKGROIND OF THE INVENTION

1. Field of the Invention

The present invention relates to an exercising device, and more particularly to such a device for exercising by repeated bending or flexing of the ankles by a person in a standing position.

2. Description of the Prior Art

The prior art includes a variety of exercising apparatus having various elements movably mounted on a frame for actuation by various extremities of the body. However, insofar as is known to the applicant none of these is adapted for exercising the leg by repeated bending of the ankle joint while the user enjoys the safety of a surrounding stall. In any event, the prior art apparatus is intended for development of muscular strength by athletes and the like and provides substantial resistance to movement of the extremities. The prior art apparatus is not, therefore, adapted to exercise which does not involve substantial exertion and is unnecessarily expensive for use in performing exercises involving limited exertion.

As is well known, the normal movement of the leg muscles assists substantially in normal circulation of the blood by, in effect, pumping blood from the legs back toward the heart. Very little exertion is required to develop the requisite pumping action, simple movement of leg muscles being sufficient.

It is difficult for persons who are somewhat crippled, as by arthritis, or who are confined in a small area, as in a hospital or in an apartment during bad weather, to move the legs sufficiently to maintain proper circulation therein. While such exercise could be obtained by walking, the necessary exertion is often extremely painful or prevented by weakness, or unfavorable environmental conditions, and in any event, only limited exertion is necessary for proper circulation in the legs.

PRIOR ART STATEMENT

In conformance with 37 C.F.R. 1.97 and 1.98, the applicant states that he is not aware of any prior art which is relevant to the patentability of the subject invention.

SUMMARY OF THE INVENTION

It is an object of the present invention to provide an improved exercise device for exercising the leg muscles by repeated bending or flexing of the ankle joints.

Another object is to provide such a device which exercises the leg muscles to improve circulation without requiring excessive exertion.

Another object is to provide such a device for exercising the leg muscles of persons who are crippled by painful conditions and/or muscular weakness.

Another object is to provide an exercising device which guides the legs, without forcing, so that the muscles utilized in bending the ankle joint are exercised.

Another object is to provide such a device which is relatively inexpensive and adapted for use in a confined area.

A further object is to provide improved elements and arrangements thereof in an exercising device which is durable and is fully effective in carrying out its intended purposes.

DESCRIPTION OF THE PREFERRED EMBODIMENT

Figure 1:
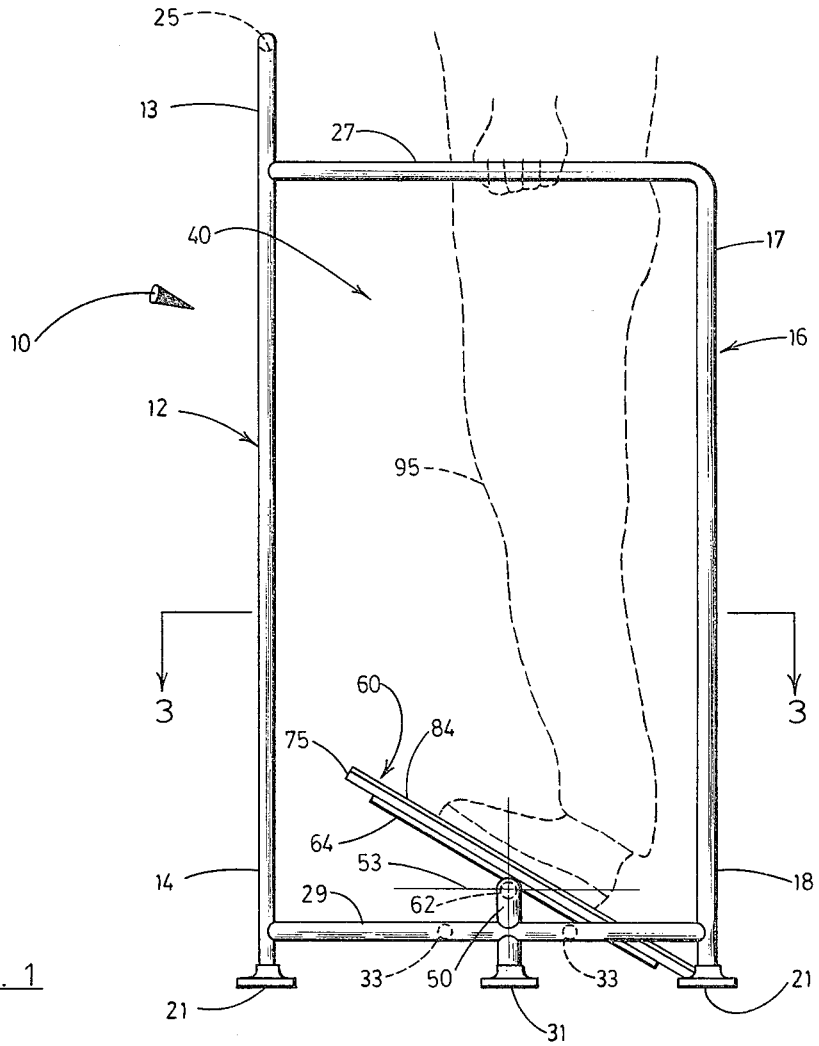
FIG. 1 is a side elevation of an exercising device embodying the principles of the present invention with a treadle in an oblique disposition and with a portion of the body of a user represented by dash lines.

Referring with greater particularity to the drawings, in FIGS. 1 through 4 is shown an exercising device embodying the principles of the present invention. The device has a frame, indicated generally by the numeral 10, of substantially rectangular parallelpiped configuration.

The frame 10 includes a pair of erect forward posts 12 of substantially equal length having individual upper end portions 13 and lower end portions 14. The frame includes a pair of rearward posts 16 of substantially equal length. The rearward posts are substantially parallel to the forward posts and have individual upper end portions 17 and lower end portions 18. The lower end portions of the posts terminate in feet 21. The feet are substantially identical and have individual downwardly disposed planar surfaces which are larger in area than the cross-section of the posts. These surfaces lie in a common horizontal plane. The rearward posts are substantially longer than the forward posts and are interconnected at their upper ends by a substantially horizontal, transversely extending rearward rail 25. The frame includes a pair of substantially horizontal upper side rails 27 interconnecting the upper end portions of each transversely corresponding pair of forward and rearward posts 13 and 17. Said side rails extend from the upper ends of their respective forward posts. The lengths of the posts are such that the rearward rail and the upper side rails are spaced above the plane of the feed a distance such that the rails may be grasped conveniently by a person standing with the feet approximately at the elevation of said plane. The frame includes a pair of substantially horizontal lower side rails 29 interconnecting the transversely corresponding lower portions of said pairs of posts 13 and 17. The lower rails are spaced somewhat upwardly from the feet. The lower rails are provided with individual feet 31 extending downwardly from the respective midpoints of the rails. The feet are substantially identical to the feet 21, having individual, downwardly disposed planar surfaces lying in the plane of the corresponding surfaces of the feet. The frame includes a pair of substantially parallel, transversely and horizontally extending spacers 33 which interconnect the lower side rails. The spacers are disposed centrally of said rails, and are spaced oppositely of the midpoint thereof toward the forward posts and toward the rearward posts.

The frame 10 defines a stall 40 having a front access opening 41 between the forward posts 12, an upper end 42 between the rearward rail 25 and the upper side rails 27, and a lower end 43 upwardly adjacent to the spacers 33. The posts 12 and 16; the rails 25, 27, and 29; and the spacers 33, preferably, are lengths of metal tubing.

These elements and the feet 21 and 31 are connected by welding.

Figure 2:
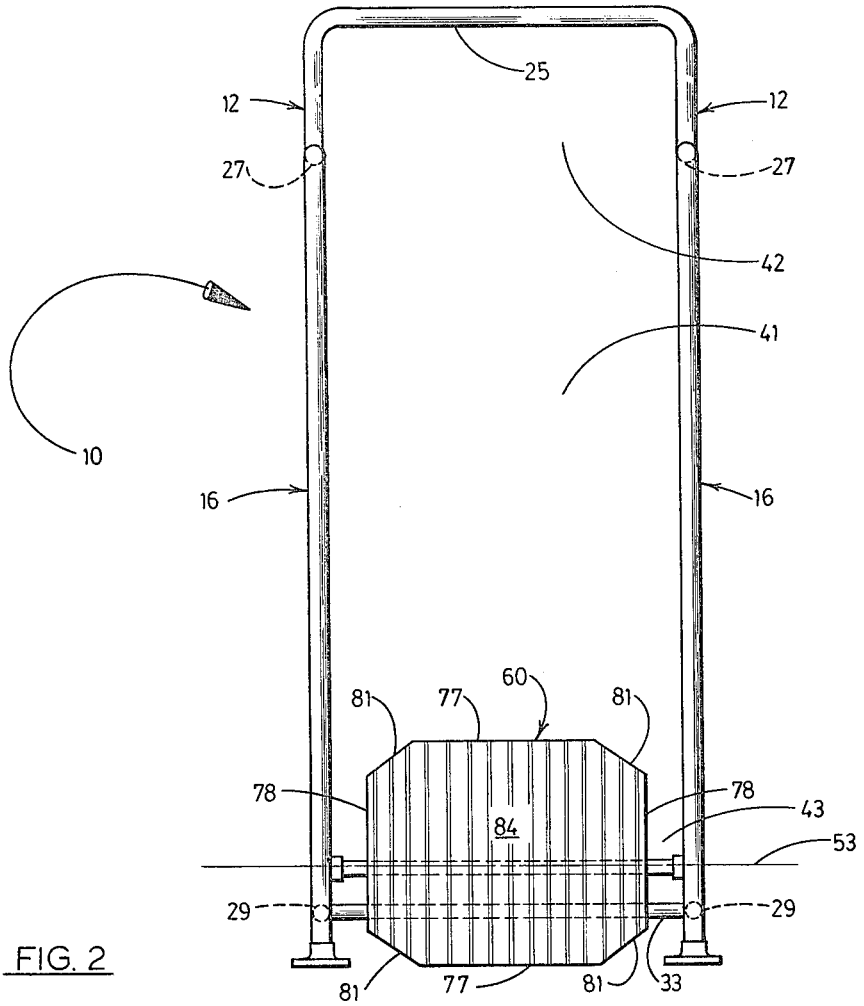
FIG. 2 is a front elevation of the device of FIG. 1.
Figure 4:
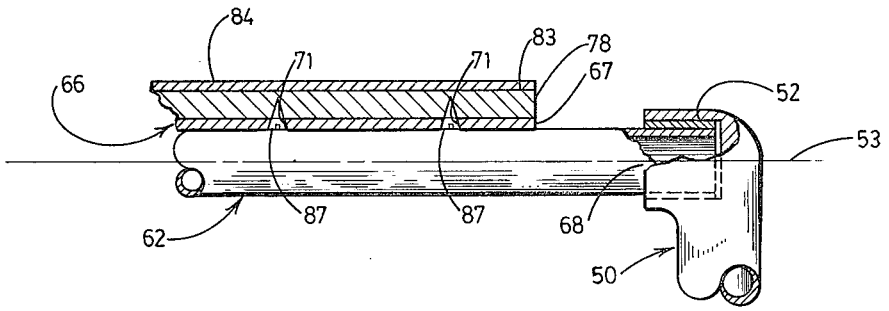
FIG. 4 is a fragmentary sectional view at an enlarged scale taken on line 4—4 of FIG. 3.

A pair of brackets 50, best shown in FIGS. 1 and 4, are individually fixedly mounted on the lower side rails 29. Each bracket is disposed at the midpoint of its respective rail and is disposed oppositely and upwardly thereof from the corresponding foot 31. The brackets are provided with individual, substantially identical, cylindrical bearings or bushings 52. The bushings are aligned transversely of the frame 10 and define an axis 53 whose position is best shown in FIGS. 1 and 2. The axis is substantially horizontal, extends substantially above the midpoint of the lower side rails 29, and is spaced upwardly from the plane of the feet 21 and 31, typically approximately two to four inches (5 to 10 centimeters). The axis thus extends transversely of the stall 40 and is inwardly spaced therein from the opening 41.

Figure 3:
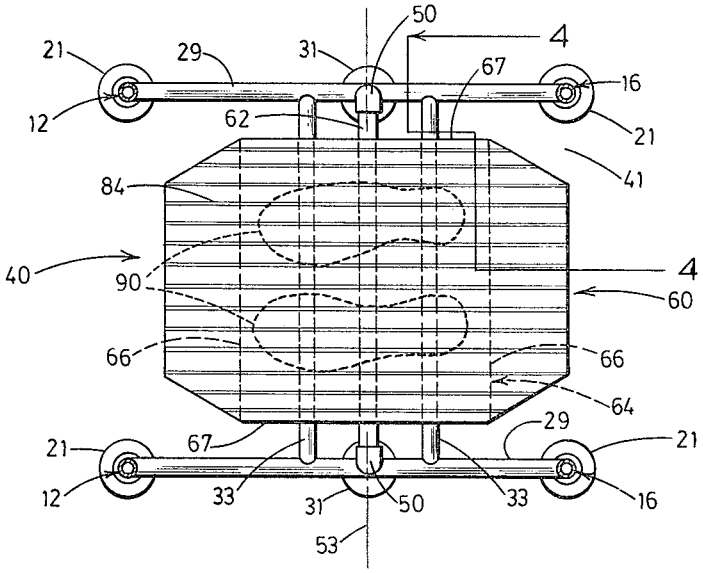
FIG. 3 is a top plan view of the lower portion of the exercising device taken on line 3—3 of FIG. 1 but with the treadle in a horizontal position.

The exercising device of the present invention has a treadle 60, best shown in FIGS. 1, 3, and 4, which is mounted on the brackets 50 for pivotal or rocking movement about the axis 53. The treadle has a cylindrical tube 62 aligned with said axis. The exterior dimensions of the tube are such that it is fitted to the bushings 52 for relatively free pivotal movement therein. The treadle has a rectangular plate 64 fixedly mounted on the upper portion of the tube. Typically, the plate and tube are metallic and are connected by welding. The plate is approximately square and is disposed with a pair of its opposite sides 66 extending parallel to said axis. Said sides are interconnected by sides 67 which are spaced a distance somewhat less than the distance between the bushings. As a result, the ends of the tube extend outwardly beyond the sides 67 defining a pair of trunnions 68 which are individually pivotally received in the bushings 52. The plate 64 is provided with a plurality of bores 71 disposed in a pair of rows individually extending parallel to and inwardly of the sides 66.

The treadle 60 has a platform 75 which is fixedly mounted on the plate 64. The platform has a pair of transverse sides 77 which are substantially parallel to the axis 53 and a pair of longitudinal sides 78. The transverse sides are spaced a distance substantially equal to the spacing of the corresponding sides 66 of the plate. The longitudinal sides of the platform are substantially longer than the transverse sides, so that the platform extends longitudinally in opposite directions from the plate. The corners of the platform are preferably chamfered as indicated by the numerals 81. The platform has an upwardly disposed planar surface 83. As best shown in FIG. 1, the axis 53 is thus disposed in downwardly adjacent relation to said surface. Said surface is provided with a non-skid finish 84, such as a mat of rubber or plastic material. The platform, typically, is constructed of wood and is secured to the plate by a plurality of screws 87 which extend individually through the bores 71. The dimensions and proportions of the platform are such that it extends substantially outwardly of the feet of a person disposed in side-by-side relation and rested centrally on the platform in the position indicated by the numeral 90 in FIG. 3. In this position the feet are disposed transversely oppositely of the platform with the toes toward the rearward posts 16 and the heels toward the forward posts 12.

OPERATION

The operation of the described embodiment of the exercising device of the present invention is believed to be clearly apparent and is briefly described at this point.

A person desiring to exercise on the device faces the opening 41, grasps the upper side rails 27 and steps onto the surface 83 of the treadle. The body is then moved into the standing position indicated by the numeral 95 in FIG. 1 with the feet supported on the platform 75 and centered on the axis 53 in the position 90. The hands are depicted in FIG. 1 as grasping said side rails. However, the rearward rail 16 can be grasped instead or the hands can be shifted as desired during exercise. When the body and feet are disposed in the depicted position, it will be noted that the feet are disposed in upwardly adjacent relation to the axis 53 and that said axis extends transversely of the feet in a plane which extends transversely of the feet and vertically through them.

When the user has assumed the position indicated by the numerals 90 and 95, the legs are exercised by repeated bending of the ankle joints by rocking the treadle 60 while the feet are supported thereon. Since the treadle pivots freely in the bushings 52 and the body is supported on the treadle and by the rails 25 or 27, relatively little exertion is required for this exercise. However, since the weight of the body is supported on the platform 75 above the axis 53, when the treadle is inclined in either direction from the horizontal the treadle is tilted by said weight toward its corresponding extreme inclination as depicted in FIG. 1. The user is, therefore, encouraged to bend the ankle joints as far as possible, As a result, the large muscles of the calf of the leg utilized in bending the ankle are alternately extended to the greatest extent possible. It will be noted from FIG. 1, that since said axis is below the feet of the user, the knee joints cannot assist in the feet following the rocking movements of the treadle. As a result, the feet can only follow these movements by bending at the ankle joint.

Although the exercise device of the present invention provides for maximum bending of the ankle joints, such bending is not forced but is only encouraged by the device. When the bending becomes painful or otherwise reaches an undesirable extent, the movement of the treadle can be easily reversed since the center of gravity of the body does not move forwardly or rearwardly of the axis 53 to the great extent during rocking of the treadle. Such movement is sufficient to urge the treadle "over center," but is not great enough to provide sufficient leverage to force the treadle to move to the extreme limits of its rocking movement. As a result the exercise device can be used by persons who are crippled by pain or muscular weakness without inconvenience.

As is well known, movement of the leg muscles tends to pump blood from the legs back to the heart. Due to pain or weakness, such movement of the legs often cannot be sustained by persons who are too crippled to walk vigorously. As a result, these persons often develop poor blood circulation in the legs. This poor circulation, of course, aggravates the crippling condition. The exercise device of the present invention thus provides for exercise of the leg muscles by such persons to improve circulation in the legs without pain and without more exertion than their crippled condition allows.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. An exercising device comprising a substantially parallelipiped frame having a pair of erect forward posts, a pair of erect rearward posts, lower side rails interconnecting the lower end portions of corresponding forward and rearward posts, spacers interconnecting the lower side rails, opposite substantially horizontal, parallel, upper side rails interconnecting the upper end portions of corresponding forward and rearward posts, and a substantially horizontal rear rail interconnecting the upper end portions of the rearward posts, defining a stall having upper and lower ends and a front access opening; a treadle; and means mounting the treadle on the lower side rails for rocking movement in a predetermined path about a substantially horizontal axis disposed substantially transversely of the upper side rails in inwardly spaced relation to the access opening, said treadle being substantially planar and the axis being in downwardly spaced adjacent relation to the treadle, the spacers being located below the treadle and in the path of the treadle to limit the rocking movement thereof.

* * * * *

UNITED STATES PATENT AND TRADEMARK OFFICE

CERTIFICATE OF CORRECTION

PATENT NO. : 4,270,749

DATED : June 2, 1981

INVENTOR(S) : William D. Hebern

It is certified that error appears in the above-identified patent and that said Letters Patent are hereby corrected as shown below:

Column 2, Line 45, delete "feed" and insert ---feet---,

Column 5, Line 8, delete "parallelipiped" and insert ---parallelepiped---.

Signed and Sealed this

*Fourth* Day of *August 1981*

[SEAL]

*Attest:*

GERALD J. MOSSINGHOFF

*Attesting Officer*

*Commissioner of Patents and Trademarks*